US008716631B2

(12) United States Patent
Venezia et al.

(10) Patent No.: US 8,716,631 B2
(45) Date of Patent: May 6, 2014

(54) FULL GLASS OVEN DOOR

(75) Inventors: Michele Venezia, Taino (IT); Marco Giuliani, Travendona Monate (IT); Cristina Mazzetti, Varese (IT)

(73) Assignee: Whirlpool Corporation, Benton Harbor, MI (US)

( * ) Notice: Subject to any disclaimer, the term of this patent is extended or adjusted under 35 U.S.C. 154(b) by 994 days.

(21) Appl. No.: 12/413,803

(22) Filed: Mar. 30, 2009

(65) Prior Publication Data

US 2009/0255918 A1 Oct. 15, 2009

(30) Foreign Application Priority Data

Apr. 10, 2008 (EP) ..... 08103474

(51) Int. Cl.
*A21B 1/00* (2006.01)

(52) U.S. Cl.
USPC ..... 219/391; 219/702

(58) Field of Classification Search
USPC ..... 219/739–743, 756, 391–392, 399, 744, 219/722, 724, 757, 679, 681, 401; 126/190, 126/198, 200, 194, 21 A, 21 R, 299 R, 299 D; 99/339, 473, 476, 341, 324; 700/83, 700/275

See application file for complete search history.

(56) References Cited

U.S. PATENT DOCUMENTS

| | | | | |
|---|---|---|---|---|
| 3,489,135 | A * | 1/1970 | Astrella | 126/198 |
| 4,255,640 | A * | 3/1981 | Bressler | 219/704 |
| 5,491,314 | A * | 2/1996 | Dorsey | 200/313 |
| 5,958,278 | A * | 9/1999 | Engebritson et al. | 219/741 |
| 6,300,609 | B1 * | 10/2001 | Kim | 219/702 |
| 7,211,775 | B2 * | 5/2007 | Lee | 219/702 |
| 2001/0009256 | A1 * | 7/2001 | Nasu et al. | 219/739 |
| 2007/0251520 | A1 * | 11/2007 | Bang | 126/200 |
| 2007/0271847 | A1 * | 11/2007 | Chin | 49/70 |
| 2008/0011342 | A1 * | 1/2008 | Ryu et al. | 134/57 DL |
| 2009/0217920 | A1 * | 9/2009 | Flesch et al. | 126/190 |

FOREIGN PATENT DOCUMENTS

| | | | |
|---|---|---|---|
| DE | 102006001246 | A1 | 7/2007 |
| DE | 102006001248 | A1 | 7/2007 |
| DE | 202008000135 | U1 | 3/2008 |
| EP | 1120606 | A2 | 8/2001 |
| WO | WO2007/080046 | A2 * | 7/2007 |
| WO | 2008051050 | A1 | 5/2008 |

OTHER PUBLICATIONS

European search report for corresponding EP08103474.6, May 8, 2009.

* cited by examiner

*Primary Examiner* — Henry Yuen
*Assistant Examiner* — Phuong Nguyen

(57) ABSTRACT

An oven door comprises a structure with internal glass plates, the external glass plate being bigger than the internal glass plates. The door further comprises a housing of polymeric material for electrical and/or electronic components of an user interface integral with the door, the housing being shell-shaped and being mounted on an internal face of the external glass plate, above the internal glass plates.

8 Claims, 2 Drawing Sheets

FULL GLASS OVEN DOOR

BACKGROUND OF THE INVENTION

1. Field of the Invention

The present invention relates to an oven door comprising a structure with at least two glass plates, one external plate being bigger than an internal plate. More particularly, the invention relates to an oven door that has the display and the user interface integrated in it.

2. Description of the Related Art

Full glass door executions, where the external glass plate defines the overall dimension of the door, usually don't have integrated display/electronic controls due to temperature limits. The user interface is then placed on the oven structure.

A solution is known by DE-A-102006001246 in which a unit containing the operating controls for the oven is mounted in a space created in the door, and particularly in shaped recesses or apertures in the front panel of the oven.

This solution, even if it makes the assembly of the user interface and display simple, cheap and easily serviced, is not fit for full glass doors and it does not solve the problem of user interface overheating. Moreover the technical solution disclosed in the document is adapted to be used in oven doors having an upper portion (the one in which the recess id formed) made of metal or the like. As a matter of fact this known solution is not adapted to be used in full glass doors since to provide a recess on the edge of a glass plate would be very difficult and expensive. In DE-A-102006001246 the recess is placed on a metal upper portion of the door, above the external glass plate.

SUMMARY OF THE INVENTION

An aspect of the present invention is to provide an oven door which does not present the above problems and in which the electrical and electronic components of the user interface may be stored on the door itself without any problem of overheating. Another aspect present invention is to provide a full glass door in which the electronic and electrical component thereof, for instance the display and touch switches and selectors of the user interface can be easily installed.

The above aspects are obtained with to the features listed in the appended claims.

The technical solution according to the invention allows managing the maximum temperature reached on a full glass door. This allows having the display and the electronic controls assembled on the door itself.

The door structure consists of two main vertical profiles attached on the outer door glass pane that supports a plastic housing or enclosure.

This enclosure is made of two parts: the inferior one is holding the electronic display/board, thus providing insulation from direct contact with glass/metal. This part is also providing an outlet path for the ventilation of the door having integrated air passages in it.

The upper part completes the thermal insulation by protecting the electronics from the heat coming from the oven.

BRIEF DESCRIPTION OF THE DRAWINGS

Other features and advantages of a door oven according to the present invention will be clear from the following detailed description, with reference to the attached drawings, in which.

DETAILED DESCRIPTION OF THE PREFERRED EMBODIMENTS

Figure 4:
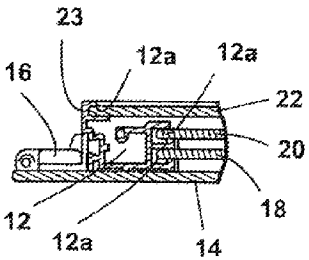
FIG. 4 is a cross section along line IV-IV of FIG. 2.

With reference to the drawings, a full glass oven door 10 comprises two vertical structural profiles 12 whose cross section can be seen in FIG. 4. Each profile 12 is fixed, for instance by means of an adhesive, to the inside surface 14*a* of an external glass plate 14 defining the overall dimension of the door 10. To one of the profiles 12, on the right one shown in FIG. 2, a portion of a side hinge 16 is fixed, even if the side hinge may be fixed to the external glass plate 14 or to the plate and to the profile 12 as well. On the right side of the door 10 (with reference to FIG. 1), a handle 21 is fixed to the external glass plate 14. The handle 21 is a profile with a C-shaped cross section and presents a portion 21*a* fixed, for instance by means of an adhesive, to the inside surface 14*a* of the external glass plate 14 (FIG. 2). In an alternative solution the handle 21 may be mechanically fixed to the adjacent profile 12 in a dovetail-shaped portion 23 thereof (FIG. 4).

In longitudinal grooves 12*a* of each profile 12 three internal glass plates 18, 20 and 22 are inserted in order to increase the thermal insulation of the door. Even if in the drawings three internal glass plates are shown, it is clear that only one or two internal glass plates can be used depending on the oven type, and the number of internal glass plates is not limited to three. It is important to notice that, independently on the width of the internal glass plates 18, 20 and 22 (the most inner plate 22 being wider that the other two plates 18 and 20), the height of the external glass plate 14 is higher than the height of the internal glass plates 18, 20 and 22, so as to define a rectangular area A (FIG. 2) for the user interface of the oven.

Figure 1:
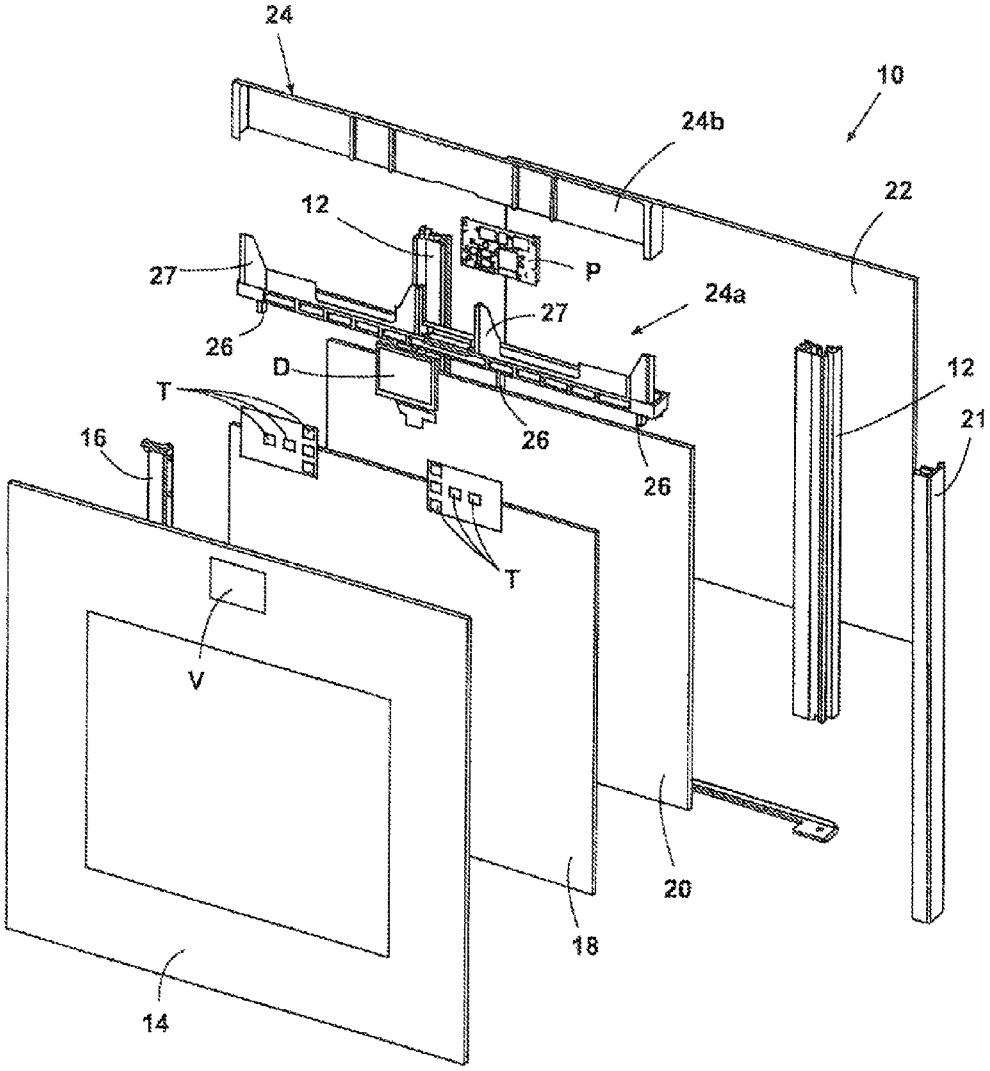
FIG. 1 is an exploded perspective view of an oven door according to the invention.
Figure 2:
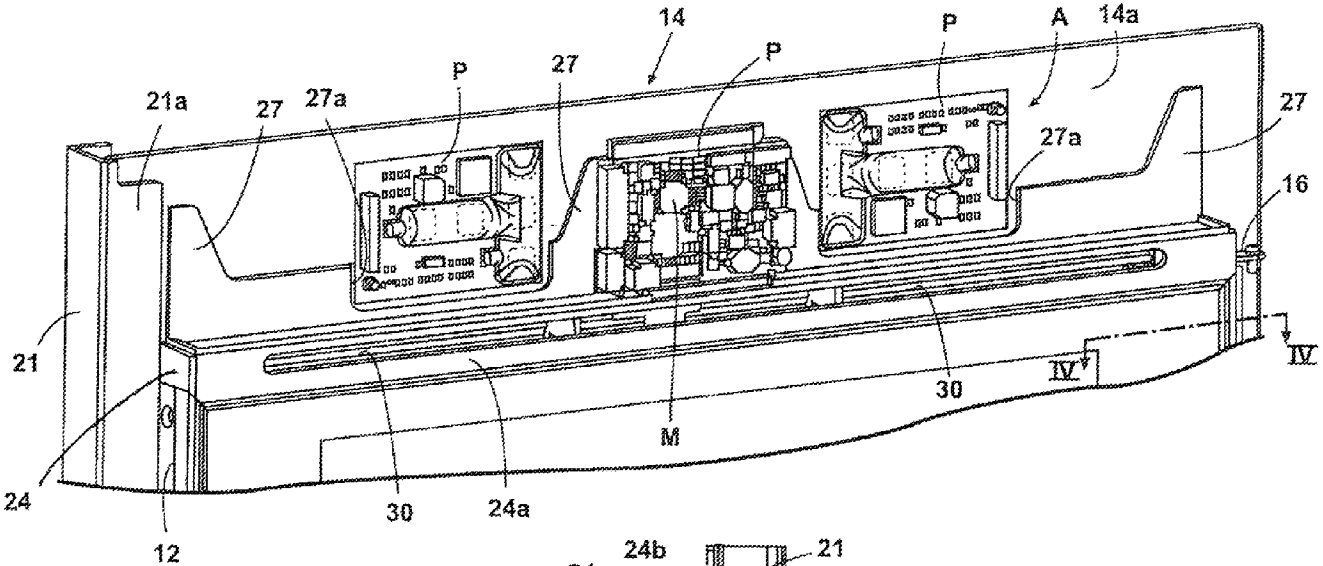
FIG. 2 is a perspective view of a detail of the door of FIG. 2, in which a component has been removed.
Figure 3:
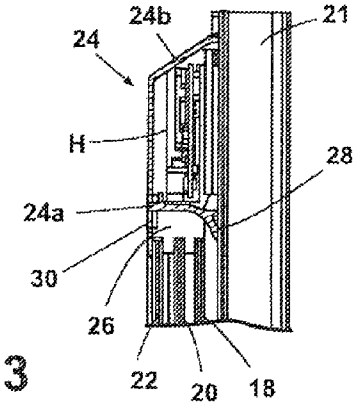
FIG. 3 is a vertical cross section of the detail shown in FIG. 2, in which the removed component has been mounted.

As it is shown in FIGS. 1 and 2, on the internal glass plates 18, 20 and 22 a base element 24*a* of a housing 24 is mounted. The base element 24*a* formed by injection molding of a polymeric material, and on its lower side it presents comb-shaped portions 26 adapted to maintain the distance between the internal glass plates 18, 20, 22 and the external glass plate 14 at a predetermined value. A similar element (not shown) is mounted between the vertical profiles 12 in the lower portion of the door 10. On the base element 24*a* of the housing 24 electrical and electronic components of the user interface of the oven are installed, for instance printed circuit boards P with microprocessors M, touch sensors T and a display D visible through a dedicated area V of the external glass plate 14. The base element 24*a* of the housing 24 presents, on a front side thereof with reference to the installed configuration of the door on the oven cavity, shaped abutment flat portions 27 whose main function is to define, by contacting the internal face 14*a* of the external glass plate 14, a predetermined distance between the internal glass plates 18, 20, 22 and the external glass plate 14 and to facilitate the correct mounting of the electrical and/or electronic components of the user interface in recesses 27*a* of the abutment portions 27. On the base element 24*a* a shell-shaped cover 24*b* is mounted, for instance through snap-engagement fixing means, in order to define, with the external glass plate 14 and with the base element 24*a*, a closed space H for the electrical and electronic components (FIG. 3). The overall housing has therefore a vertical C-shaped cross section, with an open face closed by and in contact with the inside wall 14*a* of the external glass plate 14.

The base element 24*a* of the housing 24 has not only the function of supporting the electrical or electronic components of the user interface, but also the function of being an air flow deflector for the cooling air flowing between the glass plates 14, 18, 20 and 22 of the door 10. With reference to FIG. 3, the base element 24*a* presents a lower face 28 with a curved shape in order to deflect an air flow coming from the space between the glass plates towards air passages 30 in form of slots defined in the base element 24*a* as well. The air flow is then delivered, in a known manner, to a ventilation and cooling system of the oven (not shown).

Moreover, the air flow, being in contact with a lower wall of the housing 24, helps to keep low the inside temperature of the housing so that the electronic components do not present overheating and failure problems.

We claim:

1. A domestic oven comprising:

a cavity closed by an oven door, the oven door including:

an internal glass plate that increases thermal insulation of the oven door;

an external glass plate being bigger than, and spaced apart from, the internal glass plate;

an elongated housing for electrical or electronic components including a base portion extending across and mounted on an upper edge of the internal glass plate and an upper portion mounted on an internal face and facing a dedicated area of the external glass plate, above the internal glass plate, wherein the elongated housing provides thermal insulation that protects the electrical or electronic components from heat coming from the oven; and a user interface, including electrical or electronic components, mounted in the housing entirely behind the external glass plate, wherein the user interface is visible through the dedicated area of the external glass plate.

2. The oven according to claim 1, wherein the housing is made of polymeric material.

3. The oven according to claim 1, wherein the housing further comprises a shell-shaped cover detachably mounted to the base portion.

4. The oven according to claim 1, wherein the base portion of the housing has a lower curved side adapted to deflect a cooling air flow coming from an interspace between the internal and the external glass plates towards vent apertures in the base portion and towards a ventilation system of the oven.

5. The oven according to claim 1, wherein the oven door further includes at least a second internal glass plate and the base portion of the housing presents, on its lower side, comb-shaped elements that engage the internal glass plates to maintain the internal glass plates at a predetermined distance from one another.

6. The oven according to claim 1, wherein the oven door further comprises:

two vertical structural profiles fixed to the external glass plate, and at least a second internal glass plate, wherein the internal glass plates are mounted between the vertical structural profiles at a predetermined distance from the external glass plate, the housing being supported by each of the internal glass plates and in contact with the external glass plate.

7. A domestic oven comprising:

a cavity closed by an oven door, the oven door including:

an internal glass plate;

an external glass plate being bigger than the internal glass plate;

an elongated housing for electrical or electronic components including a base portion extending across and mounted on an upper edge of the internal glass plate and an upper portion mounted on an internal face of the external glass plate, above the internal glass plate;

a user interface, including electrical or electronic components, mounted in the housing entirely behind the external glass plate; and two vertical structural profiles fixed to the external glass plate, and at least a second internal glass plate, wherein the internal glass plates are mounted between the vertical structural profiles at a predetermined distance from the external glass plate, the housing being supported by each of the internal glass plates and in contact with the external glass plate, wherein the external glass plate has, on a first side edge thereof, elements adapted to be hinged to the cavity and, on a second side edge thereof, opposite to the first side edge, a handle.

8. The oven according to claim 7, wherein the handle has a C-shaped profile with a portion fixed to the internal face of the external glass plate or to an adjacent vertical structural profile.

* * * * *